US005715503A

United States Patent [19]

Leone et al.

[11] Patent Number: 5,715,503

[45] Date of Patent: Feb. 3, 1998

[54] METHOD AND APPARATUS FOR SCAVENGING CARRIER EMPLOYING A MAGNETIC FIELD AND ERASE RADIATION

[75] Inventors: Salvatore Leone, Rochester; Donald S. Rimai, Webster; Orville C. Rodenberg; Catherine Newell, both of Rochester; Andrew J. Mauer, Warsaw; Susan P. Farnand, Fairport, all of N.Y.

[73] Assignee: Eastman Kodak Company, Rochester, N.Y.

[21] Appl. No.: 655,583

[22] Filed: May 30, 1996

[51] Int. Cl.[6] ..... G03G 21/00; G03G 15/09

[52] U.S. Cl. ..... 399/264; 399/129

[58] Field of Search ..... 399/127, 128, 399/129, 264

[56] References Cited

U.S. PATENT DOCUMENTS

| | | | |
|---|---|---|---|
| 4,952,979 | 8/1990 | Koefferlein et al. | 399/264 |
| 5,184,194 | 2/1993 | Mosehauer et al. | 355/297 |

*Primary Examiner*—Joan H. Pendegrass
*Attorney, Agent, or Firm*—Leonard W. Treash

[57] ABSTRACT

Magnetic carrier particles are removed from a photoconductive image member by subjecting the carrier particles to a magnetic field while or after exposing the photoconductive image member to erasing radiation in the absence of a substantial electrical field affecting the carrier particles.

6 Claims, 3 Drawing Sheets

METHOD AND APPARATUS FOR SCAVENGING CARRIER EMPLOYING A MAGNETIC FIELD AND ERASE RADIATION

This invention relates to the removal of magnetic carrier particles from a toner image on a photoconductive image member.

U.S. Pat. No. 5,184,194 to Mosehauer et al, granted Feb. 2, 1993, shows a scavenger for removing carrier particles from a toner image carried by a photoconductive image member. The scavenger can be employed as part of a development station or separate from the development station. In either case, a magnetic field and an electrostatic field are used in combination to attract carrier away from a toner image when that carrier is loosened by exposure of the photoconductive image member through a transparent base to radiation to which it is sensitive.

When the scavenger is used separately from the development station, an erase lamp is positioned on the backside of the image member from a rotating magnetic member. A substantial DC bias, for example, of 1300 volts is applied to a conductive member between the magnet and the image member of a polarity attractive to properly charged carrier particles.

When the scavenger is employed as part of a development station, both the erase lamp and the scavenging electrostatic field are applied after the development zone but while the image is still under the influence of the magnetic field used for movement of the developer for development. Development itself requires an electrostatic field generally of a direction encouraging the deposit of toner in image areas but discouraging deposit in background areas. In the scavenging area, a separate DC bias is applied to a scavenging electrode. The DC bias is of a higher magnitude than the development bias and is of a polarity to attract carrier that is charged properly. This bias creates a field that repels the toner in the image, although some toner may be pulled off because of close attraction to the carrier that is removed.

This prior structure has been shown to provide extremely high scavenging efficiencies as a percent of deposited carrier. It is considerably more effective than the same structure without the erasing radiation.

Although DC bias scavengers are relatively simple to build and operate, they do have certain limitations. Most significantly, these scavengers tend to become contaminated with toner particles. This contamination can become sufficiently severe within a few hundred copies to reduce the scavenging field to such a level that scavenging no longer occurs.

SUMMARY OF THE INVENTION

It is an object of the invention to improve and simplify the above-described scavenging method and device.

This and other objects are accomplished by eliminating the electrostatic scavenging features from the prior scavenging method and apparatus. We have found that using essentially the same method and apparatus as shown in the prior art, but with the scavenging electrode eliminated, at least as good results can be obtained. In some instances, even better results have been obtained than with the electrostatic scavenging bias, with scavenging efficiencies approaching 99 percent and higher.

According to a preferred embodiment, the inventive method includes removing magnetic carrier particles from a toner image on a photoconductive image member by subjecting the carrier particles to a magnetic field in the absence of a substantial electrical field affecting the carrier particles and exposing the photoconductive image member to erasing radiation prior or during application of the magnetic field.

Since the invention can be used in a development station that includes the application of a development bias, the term "in the absence of a substantial electrical field" means in the absence of an electrical field separate from or in addition to that used for development of the electrostatic image.

According to a preferred embodiment of the invention, a developer scavenger for removing magnetic carrier particles from a toner image on a photoconductive image member includes means for subjecting the carrier particles to a magnetic field urging the magnetic particles away from the photoconductive image member, means for exposing the photoconductive image member to erasing radiation before or during the presence of the particles in the magnetic field, which scavenger does not include a substantial DC electrical field affecting the carrier particles apart from any DC field used to create the toner image.

What is remarkable about the invention is that the scavenging effect is at least as good without the electrostatic field as it was in the prior art with a direct current electrostatic field. This greatly simplifies the apparatus by eliminating a large electrostatic field and the electrodes providing it.

What appears to be a slight improvement over the prior art can best be explained by the existence of several factors. First, the to application of an electrostatic field polarizes the carrier particle. This, in turn, results in the carrier particle polarizing the PC so as to minimize the induced field. Thus, as a result of the electrostatic field, the carrier particle is attracted to the photoconductive image member. Secondly, the electrostatic field has a positive effect only on carrier particles that are properly charged. Some carrier particles that have a tendency to be attracted to toner images are improperly charged, having the same polarity as that of the toner. These particles are actually repelled by the direction of the electrostatic field imposed in the prior art. The prior art suggests using two oppositely biased scavengers to overcome this problem. Third, elimination of the electrostatic field in a scavenger that is separate from the development station allows the magnet to be positioned closer to the particles being attracted than would be possible if a substantial direct current field is present.

DETAILED DESCRIPTION OF THE INVENTION

Figure 1:
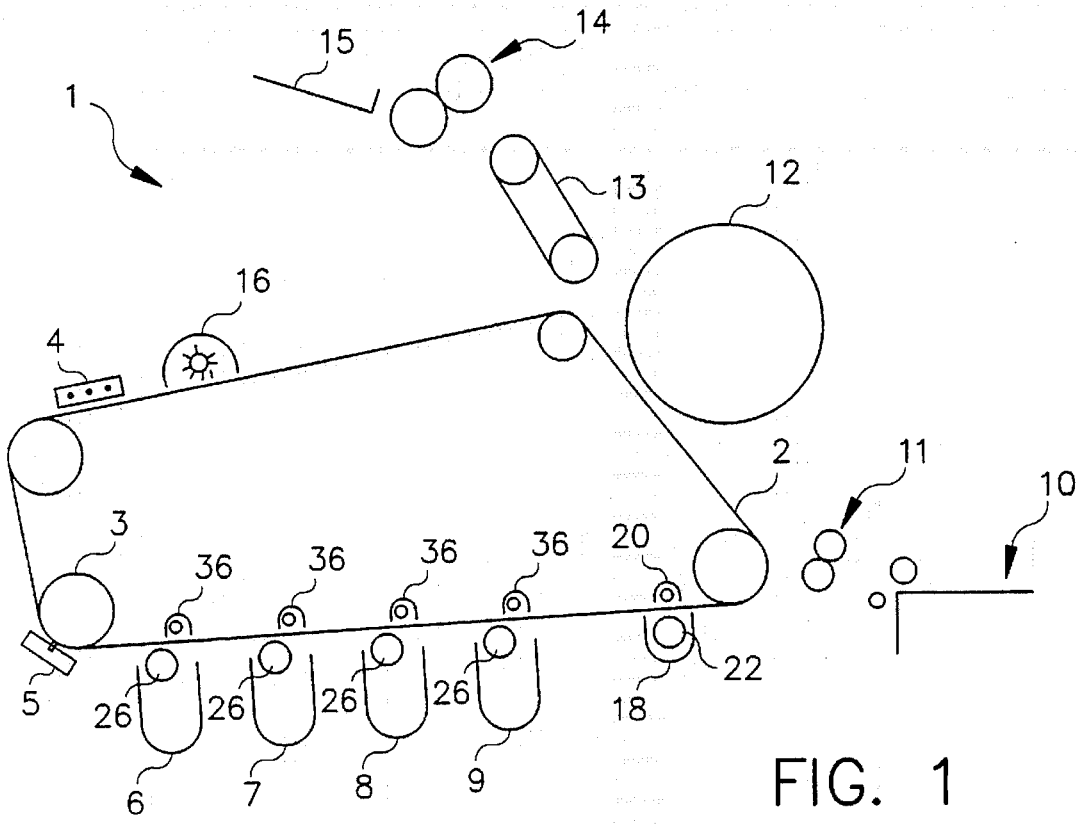
FIG. 1 is a side schematic of an image forming apparatus.

FIG. 1 shows an electrophotographic image forming apparatus 1 in which the invention is particularly usable. A photoconductive image member 2 is in the form of an endless belt trained around a series of rollers, including a drive roller 3 which drives the image member through an endless path past a series of stations to continuously create toner images. Photoconductive image member 2 preferably includes a transparent base, a conductive layer and other layers, including photoconductive layers, well known in the electrophotographic art for forming electrostatic images.

Image member 2 is uniformly charged by a charger 4 and imagewise exposed by a suitable exposing device, for example, an LED printhead 5 to create an electrostatic image. The electrostatic image is toned by one of toning stations 6, 7, 8 and 9 to create a toner image. In the image forming apparatus shown in FIG. 1, each of stations 6, 7, 8 and 9 has a different color toner so that any particular electrostatic image can be toned with a choice of one of four colors, usually including black. A receiving sheet is fed out of a receiving sheet supply 10 through a pair of timing rollers 11 and into contact with the image member 2 overlying the toner image. The toner image is transferred to the receiving sheet by an electric field applied between a transfer roller or drum 12 and the image member 2. The receiving sheet can be attached to the transfer dram to receive a number of images in registration to form a multicolor image.

The receiving sheet is separated from the image member 2 and transported by a suitable transport device 13 to a fuser 14 where it is fixed and ultimately deposited in an output tray 15. The image member 2 is cleaned at a cleaning station 16 for continuous reuse. This apparatus is well known in the art and has many variations which can use the invention.

Figure 3:
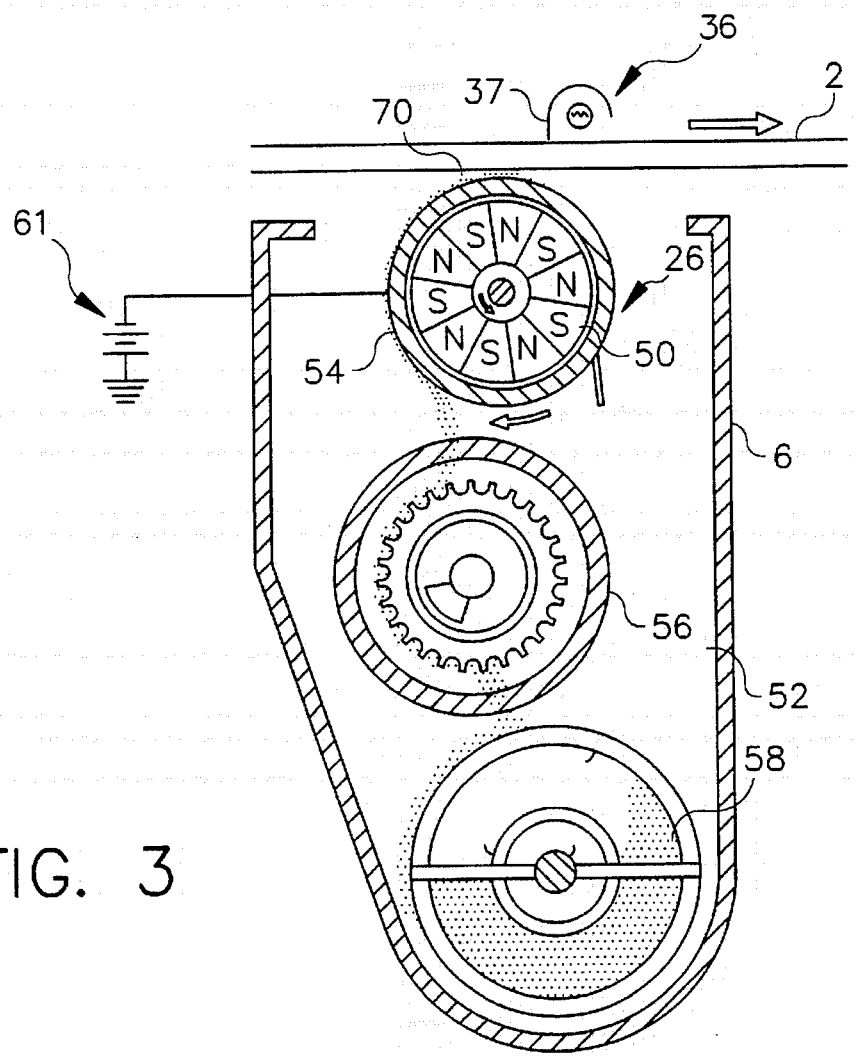
FIG. 3 is a side schematic of a development station.

Development stations 6, 7, 8 and 9 are of a magnetic brush type shown more specifically in FIG. 3. A developer made up of magnetic carrier particles and toner is mixed in a developer sump 52 by a mixing device 58. Developer can be transported by a transport device 56 to an applicator 26 for application to an electrostatic image. Transport device 56 can include a valve, not shown, for cutting off the flow of developer when the station is not being used.

Applicator 26 includes a rotatable magnetic core 50 inside a rotatable sleeve 54. Rotation of the core and the sleeve moves the developer in a clockwise direction around the outside of the sleeve 54 and through a development zone 70 between the applicator and photoconductive image member 2. A direct current bias is placed on the sleeve 54 by a voltage source 61 to establish an electrical field in the development zone 70 of a direction which urges toner particles toward the image areas of the electrostatic image but urges them away from the nonimage or background areas. Typically, if charged area development (CAD) is used, this bias might be between 50 and 150 volts above the background area of the image which is also typically between 50 and 150 volts. If discharged area development (DAD) is used, this bias would be between 50 and 150 volts below the voltage in the background areas which might typically be at 400 to 600 volts. An AC bias can also be applied which also has an effect of increasing development and reducing the tendency of carrier to be deposited with toner.

A problem with two component magnetic brush developing systems of this type is that some of the magnetic carrier gets deposited in the image and ends up having a bad effect on stations downstream the photoconductive image member and the final image. This problem is extremely well known in the art, and many solutions to it have been proposed.

Applicants have found that in a development station such as that shown in FIG. 3, the amount of carrier actually exiting the development station on the image member is reduced to almost zero by the careful placement of an erase lamp 36 immediately after the development zone 70. Erase lamp 36 exposes photoconductive image member 2 to radiation to which it is sensitive, thereby dissipating as much internal charge associated with the photoconductive layers in image member 2 as possible, greatly reducing the forces tending to attract and hold carrier particles of either polarity to the image member. Since the erase lamp is located immediately after the development zone 70, it no longer has an effect on development itself but exposes a portion of the image member that is still under the influence of the magnets and rotating magnetic core 50. This combination of a loosening effect from the erase lamp and the attraction of the magnetic core pulls the carrier off the image member extremely efficiently. The carrier then drops down into the sump 52 and is remixed for reuse. To prevent radiation from erase lamp 36 from reaching the image member at or in advance of the development zone 70, the radiation is shielded with a shield 37. The erase lamp still must be close enough to the development zone that its effect on the photoconductive layers of the image member occurs before the image member is out of the magnetic field.

FIG. 1 also shows an auxiliary scavenger 18, separate from the development stations 6, 7, 8 and 9. This scavenger is shown in more detail in FIG. 2 and includes a sump or container 42 for collected carrier particles, a scavenging component 22 which includes a rotatable magnetic core 40 and a fixed sleeve 44. An erase lamp 20 is located opposite scavenging component 22 and magnetic core 40 and, like the previous erase lamp, illuminates the photoconductive layers of image member 2 through a transparent base. Rapid rotation of core 40, for example, at 1000 revolutions per minute, causes a rapidly varying magnetic field urging the magnetic carrier particles toward the shell 44 from image member 2. Rapid rotation of core 40 causes rapid pole transitions which cause the carrier to flip and move around shell 44 in a direction opposite to the rotation of core 40, that is, in a clockwise direction to ultimately deposit the carrier particles in sump 42.

Figure 2:
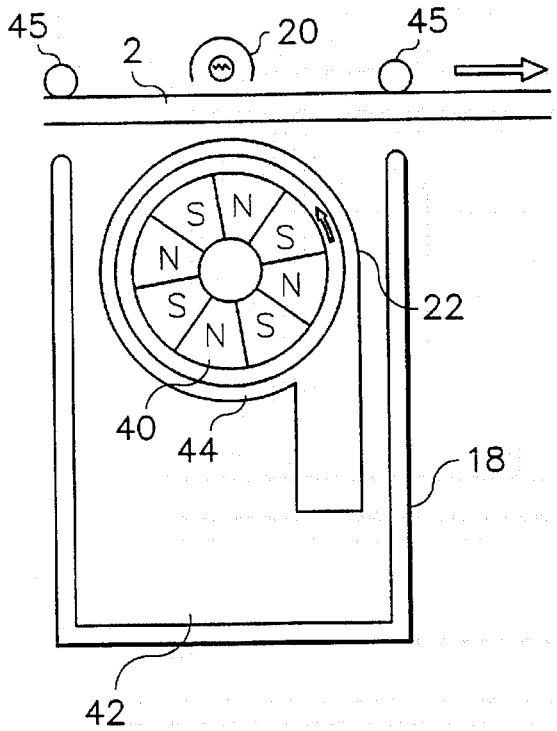
FIG. 2 is a side schematic of a developer scavenger.

In the FIG. 2 structure the erase lamp 20 is positioned directly opposite magnetic core 40 and thus illuminates the photoconductive layers where they are closest to the magnets in core 40.

Because no electrostatic bias is involved in this station at all, the shell 44 can be positioned extremely close to image member 2 which, in turn, provides a strong magnetic field on the image member surface. This smallness of separation is not practical in a system that applies a high electrostatic field as well, because of the risk of static discharge between the shell 22 and the image.

Figure 4:
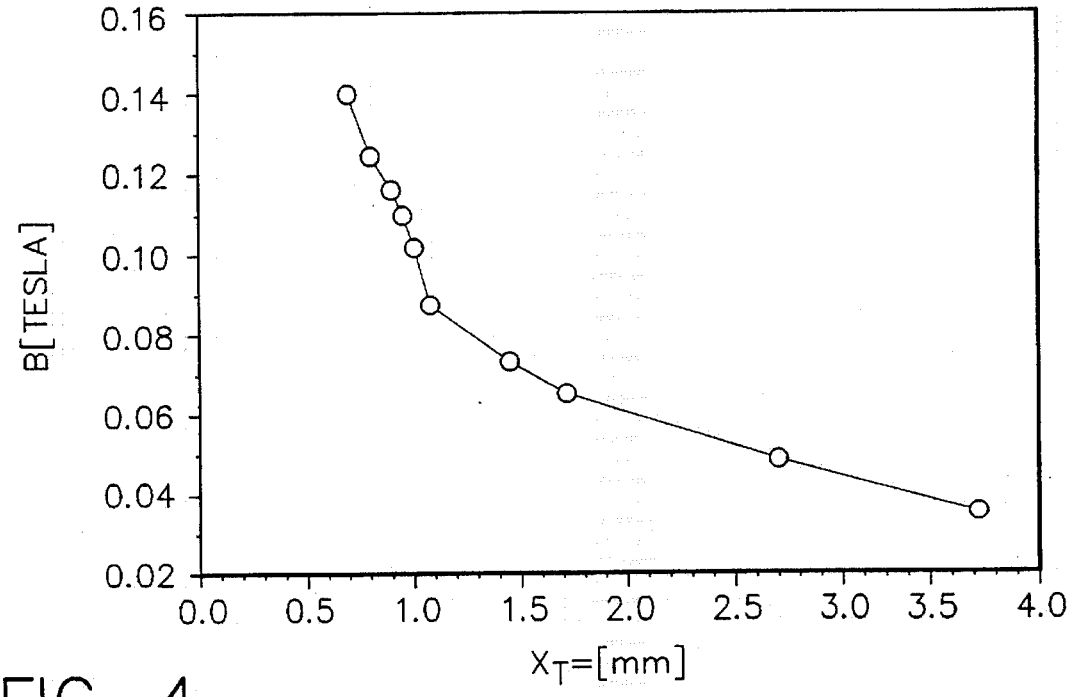
FIG. 4 is a graph illustrating the effect of spacing between a magnetic component of a development applicator and a photoconductive image member or magnetic field.

FIG. 4 is a graph of the strength of the magnetic field on the surface of image member 2 for various distances between the image member 2 and the surface of the core 40. The magnetic strengths B are measured with a Gauss probe at various distances (in mm) $X_T$ from the shell. Note the substantial fall-off in strength of the magnetic field with even slight increases in distance from the probe.

Figure 5:
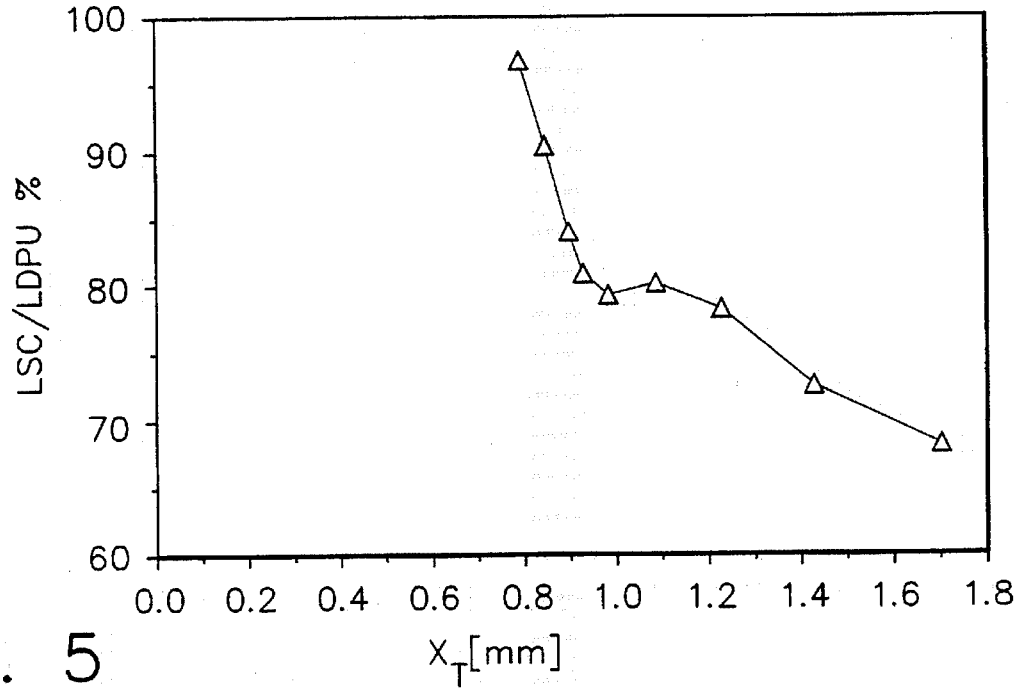
FIG. 5 is a graph illustrating the effect on scavenging efficiency of the spacing between a magnetic component and a photoconductive image member.

FIG. 5 shows measurements taken of scavenging efficiency as a function of the same distance $X_T$. The distance between the magnet and the surface of the shell is 0.68 millimeters for all measurements. Thus, if $X_T$ is 0.8 mm, the shell is only spaced 0.22 mm from the image member. The scavenging efficiency is determined by measuring the weight of carrier on the fill before and after scavenging. Note again, the substantial fall-off due to increased distance between the shell and the image member. This experiment was conducted with an erase lamp positioned prior to the magnet and on the same or front side of the image member and with a 20 pole rotatable magnetic core with a rotatable sleeve.

The photoconductive image member can be illuminated from either the front, image bearing surface or from the rear surface. Because of the constraints imposed by the location of the subsystems, such as the development station, it is preferable to expose from the rear. Any appropriate source of illumination can be used. It is preferable, however, to use a tightly collimated light source such as that coming from a light bar or an LED array in close proximity to the photoconductive element or in contact with the rear of the photoconductive element. A laser or a focused light source could also be used.

The following examples will illustrate the invention:

EXAMPLE 1

This example is meant to show the scavenging efficiency achieved using conventional scavenging. Scavenging efficiency is measured by measuring the amount of developer removed by the scavenger 18 and measuring the amount of developer left on the image member. A negative toner, high coercivity carrier two component xerographic developer was used in an Eastman Kodak 1575 copier. A DC bias of −1300 volts was applied to the primary scavenger. The scavenger was in close proximity to a development station, but no erase lamp was used. 5.374 grams of developer per 1000 copies, or approximately 91 percent of the developer deposited on the photoconductor, was removed.

EXAMPLE 2

This example is similar to Example 1 except that no electrostatic field was applied. 1.702 grams of developer per 1000 copies was removed, which is approximately 23 percent of the deposited developer. This examples shows that the magnetic field is insufficient to remove the developer by itself.

EXAMPLE 3

The developed photoconductor of Examples 1 and 2 was erased from the rear after development but before scavenging. No electrostatic field was applied. Therefore, any scavenging was the result of the magnetic force acting on the developer alone. 7.0203 grams per 1000 copies of developer was removed from the image member. This was approximately 99 percent of the developer on the image member. Therefore, using a magnetic field and illumination, we were able to achieve a higher scavenging efficiency than using electrostatics plus magnetics but without the illumination.

EXAMPLE 4

Figure 6:
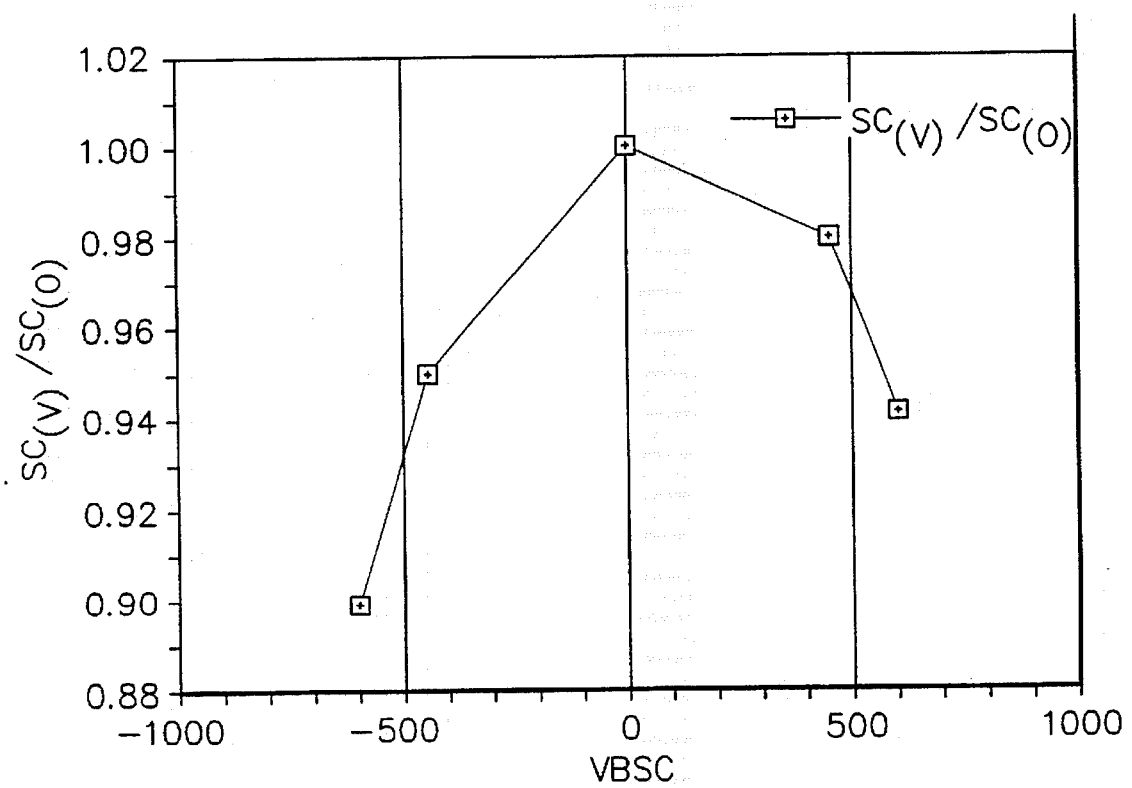
FIG. 6 is a graph illustrating the effect of an electrostatic field on scavenging efficiency.

In an attempt to determine the exact effect of eliminating the electrostatic field in a system having a magnetic field and illumination, a linear breadboard experiment was set up in which a heavy amount of carrier was deposited and removed. The efficiency $SC_{(V)}/SC_{(O)}$ was measured by weighing the image member before and after scavenging. Although the amount of developer deposited is exaggerated, this type of experiment has been shown to track reasonably experiments on commercial apparatus. The graph shown in FIG. 6 shows the results with a 20 pole rotating magnetic core and an erase lamp and a varying electrostatic field ($V_{bse}$). Although results with the electrostatic field as high as ±400 volts were still quite good, in excess of 95 percent, they were somewhat better at lower voltages and best at zero voltage. It is well known that electrically conducting materials will polarize in an electric field and that this polarization can result in an attraction between neighboring materials. Therefore, applying an electric field can actually cause carrier particles to adhere more tenaciously to an illuminated image member. Further, considering the low charge level of the carrier particles after illumination, the electrostatic removal force may be ineffective in overcoming other attractive forces in the presence of light. Thus, although we were surprised at first to find that the electrostatic force appears to have no positive effect on scavenging when an erase lamp is used, we feel that the result is explainable.

Each of the embodiments shows a rotating core magnet, both in the development unit shown in FIG. 3 and in scavenging unit 18 shown in FIG. 2. In either case, they may be combined with a rotating or a stationary sleeve. It is important that the magnetic carrier particles be subjected to varying magnetic fields. This varying magnetic field is readily supplied by the rotating core. However, it can also be supplied by stationary magnets which are arranged so that the magnetic carrier particles experience a varying field as they pass through the magnetic fields of the stationary magnets on a moving image member. A rotating sleeve can then carry the particles away.

Each of the embodiments shows erase in the presence of a magnetic field. Especially in the FIG. 2 embodiment, the same effect can also be accomplished by erase prior to application of the field. The FIG. 5 results were obtained with frontside erase prior to the magnetic field.

Erase after development and before transfer is known to have a positive effect on transfer and is commonly used for this purpose. The erase exposures commonly used for transfer can also be used in the invention. Thus, a single erase between development and scavenging can provide both positive effects, eliminating an additional pretransfer erase.

The invention has been described in detail with particular reference to a preferred embodiment thereof, but it will be understood that variations and modifications can be effected within the spirit and scope of the invention as described hereinabove and as defined in the appended claims.

We claim:

1. A scavenger for removing magnetic carrier particles from a toner image on a photoconductive image member, said scavenger comprising:

a magnetic core, a shell around said core separated from the image member by less than 0.5 mm, at least one of said core and shell being rotatable for subjecting the carrier particles to a magnetic field urging the magnetic particles away from the photoconductive image member to move carrier attracted from the image member to a storage position, and means for exposing the photoconductive image member to erasing radiation before or while the carrier particles are in the magnetic field, to move the carrier particles away from the image member without the assistance of an electrostatic field.

2. Development apparatus for developing an electrostatic image carried by a photoconductive image member, said apparatus comprising:

means defining a sump for developer of toner and magnetic carrier particles, a magnetic applicator closely spaced from the image member for moving developer through a development zone between the applicator and the image member to develop the electrostatic image, means for applying a development bias to the applicator to create an electric field in the development zone of a direction encouraging the deposit of toner in image areas of the electrostatic image and discouraging such deposit in nonimage areas, with no other electrostatic bias being applied between said development apparatus and said image member, and means for exposing the photoconductive image member to erase radiation after the development zone but before the electrostatic image leaves the influence of the electric field.

3. A development apparatus according to claim 2, wherein said magnetic applicator includes a shell and a rotatable magnetic core within the shell.

4. Image forming apparatus including:

means for forming an electrostatic image on a photoconductive image member, means for developing the electrostatic image with dry toner from a two component developer including magnetic carrier particles to form a toner image, said developing means including a development bias electric field, means for transferring the toner image to a receiving sheet, a magnetic scavenger between the developing and transferring means for removing carrier particles picked up by the image member, and an erase lamp between the development means and the magnetic scavenger for reducing charge on the image member, toner and carrier before the electrostatic image leaves the influence of said electric field to assist in scavenging and transfer.

5. A method of removing magnetic carrier particles from a toner image on a photoconductive image member, said method comprising subjecting the carrier particles to a magnetic field by rotating a magnetic core closely spaced to the image member to attract carrier particles to a shell surrounding the core, the shell being spaced less than 0.5 mm from the image member for urging the carrier particles away from the photoconductive image member and exposing the photoconductive image member to erasing radiation before or during subjection of the carrier particles to the magnetic field in the absence of a substantial electrical field affecting the carrier particles.

6. The method according to claim 5 wherein the carrier particles are hard magnetic carrier particles.

* * * * *

UNITED STATES PATENT AND TRADEMARK OFFICE

CERTIFICATE OF CORRECTION

PATENT NO. : 5,715,503
DATED : 03 February 1998
INVENTOR(S) : Salvatore Leone, et al It is certified that error appears in the above-identified patent and that said Letters Patent is hereby corrected as shown below:

| | |
|---|---|
| Title Page | insert section -- [60] Provisional application No. 60/002,712 Aug. 23, 1995.-- |

Signed and Sealed this

Twenty-sixth Day of May, 1998

*Attest:*

*Attesting Officer*

BRUCE LEHMAN

*Commissioner of Patents and Trademarks*